US011170724B2

(12) United States Patent
Li et al.

(10) Patent No.: US 11,170,724 B2
(45) Date of Patent: Nov. 9, 2021

(54) METHOD FOR DRIVING A DISPLAY PANEL, DRIVING DEVICE FOR DRIVING A DISPLAY PANEL AND DISPLAY DEVICE

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Yafei Li, Beijing (CN); Zijiao Xue, Beijing (CN); Xiaojing Wang, Beijing (CN); Shijie Zhu, Beijing (CN); Lukang Li, Beijing (CN); Lingyun Shi, Beijing (CN); Xin Duan, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/840,559

(22) Filed: Apr. 6, 2020

(65) Prior Publication Data

US 2021/0056918 A1 Feb. 25, 2021

(30) Foreign Application Priority Data

Aug. 20, 2019 (CN) ..... 201910769073.X

(51) Int. Cl.
*G09G 3/36* (2006.01)
*G09G 3/34* (2006.01)

(52) U.S. Cl.
CPC ..... *G09G 3/3607* (2013.01); *G09G 3/342* (2013.01); *G09G 2320/0233* (2013.01);
(Continued)

(58) Field of Classification Search
CPC ..... G09G 3/3607; G09G 3/342; G09G 2320/0233; G09G 2320/0242; G09G 2320/0276; G09G 2320/0673
See application file for complete search history.

(56) References Cited

U.S. PATENT DOCUMENTS

2016/0196793 A1 7/2016 Xu
2016/0299381 A1 10/2016 Lu et al.
(Continued)

FOREIGN PATENT DOCUMENTS

CN 103310752 A 9/2013
CN 104849909 A 8/2015
(Continued)

OTHER PUBLICATIONS

First Office Action dated Mar. 3, 2021 for Chinese Patent Application No. 201910769073, 25 pages.

*Primary Examiner* — Kenneth B Lee, Jr.
(74) *Attorney, Agent, or Firm* — Dave Law Group LLC; Raj S. Dave

(57) ABSTRACT

Embodiments of the present disclosure provide a method for driving a display panel, a driving device for driving a display panel and a display device. The display panel includes a first display region and a second display region each including first color sub-pixel units. The method includes obtaining a respective target grayscale of each of the first color sub-pixel units, obtaining a respective first gamma voltage of each of the first color sub-pixel units in the first display region based on the respective target grayscale, and providing the respective first gamma voltage to each of the first color sub-pixel units in the first display region, and obtaining a respective second gamma voltage of the first color sub-pixel unit in the second display region based on the respective target grayscale, and providing the respective second gamma voltage to
(Continued)

each of the first color sub-pixel units in the second display region.

18 Claims, 6 Drawing Sheets

(52) U.S. Cl.
CPC ..... *G09G 2320/0242* (2013.01); *G09G 2320/0276* (2013.01); *G09G 2320/0673* (2013.01)

(56) References Cited

U.S. PATENT DOCUMENTS

| | | | | |
|---|---|---|---|---|
| 2018/0173060 | A1* | 6/2018 | Guo et al. ..... | G02F 1/133611 |
| 2018/0197490 | A1 | 7/2018 | Gou et al. | |
| 2019/0164520 | A1 | 5/2019 | Trim et al. | |

FOREIGN PATENT DOCUMENTS

| | | | |
|---|---|---|---|
| CN | 105869598 | A | 8/2016 |
| CN | 107731152 | A | 2/2018 |
| CN | 109559696 | A | 4/2019 |

* cited by examiner

METHOD FOR DRIVING A DISPLAY PANEL, DRIVING DEVICE FOR DRIVING A DISPLAY PANEL AND DISPLAY DEVICE

CROSS REFERENCE TO RELATED APPLICATIONS

This application claims priority from Chinese Patent Application No. 201910769073.X, filed on Aug. 20, 2019, and the contents of the above-mentioned Chinese Patent Application Publication are hereby incorporated by reference in their entirety as part of the present application.

BACKGROUND

The present disclosure relates to a field of display technology, and in particular, to a method for driving a display panel, a driving device for driving a display panel, and a display device.

In order to improve the smear phenomenon of liquid crystal display products, a design with a black frame insertion for the backlight is often used. As the turn-on time of the backlight is shorter, the smear improvement is more obvious, while the brightness of the display product is smaller. In order to improve the display brightness under the black frame insertion design, some liquid crystal display products adopt a dual-backlight design. Two backlights are used to correspond to the upper and lower-half screens. By turning on the upper-half screen backlight and lower-half screen backlight alternately in a time-divisional fashion, the backlight brightness can be improved while reducing the smear of the LCD.

BRIEF DESCRIPTION

Due to the poor uniformity of the panel or the differences in backlights, there is brightness and chromaticity difference between the upper-half screen and the lower-half screen for the products with dual backlights design. Brightness and chromaticity can be adjusted through gamma correction (for example, 3gamma correction, that is, gamma correction for R, G, and B subpixels). However, conventional driving ICs can only adjust the brightness and chromaticity of the entire screen, and cannot improve the brightness and chromaticity difference of the upper-half screen and lower-half screen caused by the difference in backlights or the difference in panel.

Embodiments of the present disclosure provide a method for driving a display panel, a driving device for driving the display panel, and a display device, which can improve display uniformity of the display panel.

In a first aspect of the present disclosure, there is provided a method for driving a display panel. The display panel includes a first display region and a second display region. Each of the first display region and the second display region includes a plurality of first color sub-pixel units. The method includes obtaining a respective target grayscale of each of the first color sub-pixel units. The method further includes obtaining, a respective first gamma voltage of each of the first color sub-pixel units located in the first display region based on the respective target grayscale, and providing the respective first gamma voltage to each of the first color sub-pixel units. The method further includes obtaining a respective second gamma voltage of each of the first color sub-pixel units located in the second display region based on the respective target grayscale and providing the respective second gamma voltage to each of the first color sub-pixel units.

In some embodiments of the present disclosure, obtaining the respective first gamma voltage of each of the first color sub-pixel units based on the respective target grayscale includes obtaining the respective first gamma voltage corresponding to the respective target grayscale based on a preset first correspondence relationship between a grayscale and a gamma voltage. Obtaining the respective second gamma voltage of each of the first color sub-pixel units based on the respective target grayscale includes obtaining the respective second gamma voltage corresponding to the respective target grayscale based on a preset second correspondence relationship between a grayscale and a gamma voltage.

In some embodiments of the present disclosure, the method further includes, before obtaining the respective first gamma voltage of each of the first color sub-pixel units and obtaining the respective second gamma voltage of each of the first color sub-pixel units, obtaining a respective row pixel coordinate of each of the first color sub-pixel units, obtaining a row resolution of the display panel, and determining the display region that each of the first color sub-pixel units is located based in on the respective row pixel coordinate and the respective row resolution.

In some embodiments of the present disclosure, determining the display region that each of the first color sub-pixel units is located in based on the respective row pixel coordinate and the row resolution includes determining that a respective one of the first color sub-pixel unit is located in the first display region if the respective row pixel coordinate is less than or equal to half of the row resolution, and determining that the a respective one of the first color sub-pixel units is located in the second display region if the respective row pixel coordinate is greater than half of the row resolution.

In some embodiments of the present disclosure, obtaining the respective first gamma voltage of each of the first color sub-pixel units based on a preset first correspondence relationship between a grayscale and a gamma voltage includes perform a gamma transformation on the respective target grayscale based on the first correspondence relationship to obtain a respective first digital signal corresponding to the respective target grayscale, and perform a digital-to-analog conversion on the respective first digital signal to obtain the respective first gamma voltage.

In some embodiments of the present disclosure, obtaining the respective second gamma voltage based on a preset second correspondence relationship between a grayscale and a gamma voltage includes perform a gamma transformation on the respective target grayscale based on the second correspondence relationship to obtain a respective second digital signal corresponding to the respective target grayscale, and perform a digital-to-analog conversion on the respective second digital signal to obtain the second respective gamma voltage.

In some embodiments of the present disclosure, the method further includes providing a first backlight to the first display region after the respective first gamma voltage is provided to each of the first color sub-pixel units. Providing a second backlight to the second display region after the respective second gamma voltage is provided to each of the second color sub-pixel units.

In a second aspect of the present disclosure, a driving device for driving a display panel is provided. The display panel includes a first display region and a second display region. Each of the first display region and the second display region includes a plurality of first color sub-pixel units. The driving device includes a first acquisition circuit configured to acquire a respective target grayscale of each of the first color sub-pixel units, a first scanning circuit configured to obtain a respective first gamma voltage of each of the first color sub-pixel units located in the first display region based on the respective target grayscale, and provide the respective first gamma voltage to each of the first color sub-pixel units, and a second scanning circuit configured to obtain a respective second gamma voltage of each of the first color sub-pixel units located in the second display region based on the respective target grayscale, and provide the respective second gamma voltage to each of the first color sub-pixel units.

In some embodiments of the present disclosure, the first scanning circuit is configured to perform a gamma transformation on the respective target grayscale to obtain the respective first gamma voltage, based on a preset first correspondence relationship between a grayscale and a gamma voltage. The second scanning circuit is configured to perform a gamma transformation on the respective target grayscale to obtain the respective second gamma voltage, based on a preset second correspondence relationship between a grayscale and a gamma voltage.

In some embodiments of the present disclosure, the driving device further includes a second acquisition circuit configured to acquire a respective row pixel coordinate of each of the first color sub-pixel units, a third acquisition circuit configured to acquire a row resolution of the display panel, and a determining circuit configured to determine the display region that each of the first color sub-pixel units is located in based on the respective row pixel coordinate and the row resolution.

In some embodiments of the present disclosure, the determining circuit is configured to determine that a respective one of the first color sub-pixel units is located in the first display region if the respective row pixel coordinate is less than or equal to half of the row resolution, and determine that a respective one of the first color sub-pixel units is located in the second display region if the respective row pixel coordinate is greater than half of the row resolution.

In some embodiments of the present disclosure, the first scanning circuit is configured to obtain the respective first gamma voltage based on a preset first correspondence relationship between a grayscale and a gamma voltage by performing a gamma transformation on the respective target grayscale to obtain a respective first digital signal corresponding to the respective target grayscale based on the first correspondence relationship, and performing a digital-to-analog conversion on the respective first digital signal to obtain the respective first gamma voltage.

In some embodiments of the present disclosure, the second scanning circuit is configured to obtain the respective second gamma voltage based on a preset second correspondence relationship between a grayscale and a gamma voltage by performing a gamma transformation on the respective target grayscale to obtain a respective second digital signal corresponding to the respective target grayscale, based on the second correspondence relationship, and performing a digital-to-analog conversion on the respective second digital signal to obtain the respective second gamma voltage.

In some embodiments of the present disclosure, the driving device further includes a first backlight control circuit configured to turn on a first light source for each of the first color sub-pixel units located in the first display region to provide a backlight to the first display region after the first scanning circuit provides the respective first gamma voltage to each of the first color sub-pixel units, and a second backlight control circuit configured to turn on a second light source for each of the first color sub-pixel units located in the second display region after the respective second scanning circuit provides the respective second gamma voltage.

In a third aspect of the present disclosure, there is provided a display device including a driving device for driving a display panel according to the first aspect of the present disclosure.

In some embodiments of the present disclosure, the display device further includes a display panel connected to the driving device, the display panel including a first display region and a second display region, each of the first display region and the second display region including a plurality of first color sub-pixel units, and a backlight assembly connected to the display panel and the driving device, respectively. The backlight assembly includes a first light source for providing a backlight to the first display region and a second light source for providing a backlight to the second display region.

Compared with the prior art, the embodiments of the present disclosure have the following advantages. In the embodiments of the present disclosure, the corresponding relationships between the grayscales and gamma voltages of the first color sub-pixel units (e.g., R sub-pixel units, G sub-pixel units, and B sub-pixel units) in the first display region and the second display region have been pre-adjusted separately. The gamma voltages of grayscales of the same color after the gamma transformation are different, realizing different data voltages. Therefore, the transmittances of the first display region and the second display region can be adjusted independently, and the uniformity of brightness between the first display region and the second display region can be improved.

BRIEF DESCRIPTION OF THE DRAWINGS

To describe the technical solutions in the embodiments of the present disclosure more clearly, the accompanying drawings of the embodiments are briefly described below. Obviously, the drawings in the following description are just some embodiments of the present disclosure. For those of ordinary skill in the art, other drawings can be obtained based on these drawings without paying creative efforts.

DETAILED DESCRIPTION

In order to make the technical solutions and advantages of the embodiments of the present disclosure more comprehensible, the technical solutions of the embodiments of the present disclosure are clearly and completely described below with reference to the accompanying drawings. Obviously, the described embodiments are only a part but not all of the embodiments of the present disclosure. Based on the described embodiments of the present disclosure, all other embodiments obtained by those skilled in the art without creative efforts shall also fall within the protection scope of the present disclosure.

As used herein and in the appended claims, the singular form of a word includes the plural, and vice versa, unless the context clearly dictates otherwise. Thus, the references "a", "an", and "the" are generally inclusive of the plurals of the respective terms. Similarly, the words "comprise", "comprises", and "comprising" are to be interpreted inclusively rather than exclusively.

Figure 1:
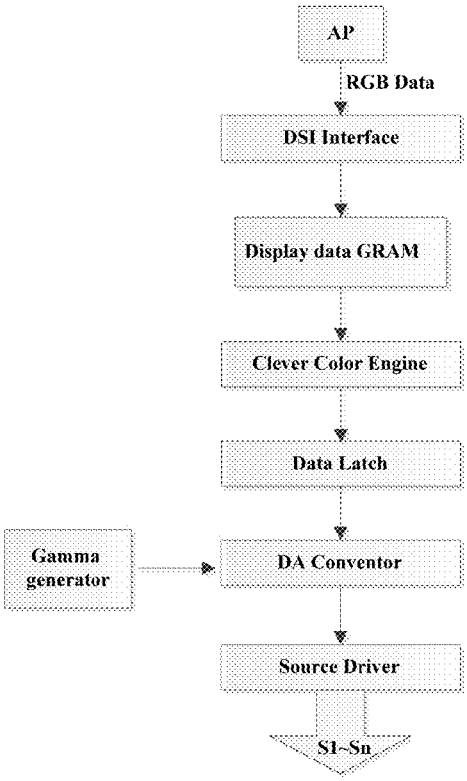
FIG. 1 is a schematic flowchart of a driving method.

FIG. 1 shows a schematic flow chart of a driving method. RGB data is sent from an application processor (AP) through an interface (for example, a display serial interface, DSI) to an IC, and then passes through a display data GRAM, an imagine processor (IP, for example, Clever color engine), a data latch, a gamma (or 3gamma) generator and a digital-to-analog DA convertor. The DA convertor converts a digital signal to an analog signal. The signal is output to data source lines (S1~Sn) of the display panel.

The 3gamma correction technology is used to adjust the chroma and brightness of a display panel. Each of color components (R, G, B) may be adjusted by an independent gamma setting, thereby affecting the chromaticity coordinates. All colors to be displayed can be realized by RGB three colors with different proportions. When the chromaticity coordinate of a white point deviates from the design value, it can be fine-tuned by a 3gamma correction of the driver IC to meet the design requirements. For example, a gamma voltage of a color component (R, G, B) can be adjusted independently through register settings of the driver IC. The RGB ratio of each grayscale can be fine-tuned by adjusting the analog voltage corresponding to each grayscale, thereby achieving different chromaticity coordinates. The inventor found that conventional driver ICs have only one gamma circuit which performs a gamma or 3gamma correction on the brightness and chromaticity of the entire screen but cannot perform a gamma or 3gamma correction on different areas of the screen, respectively.

Figure 2:
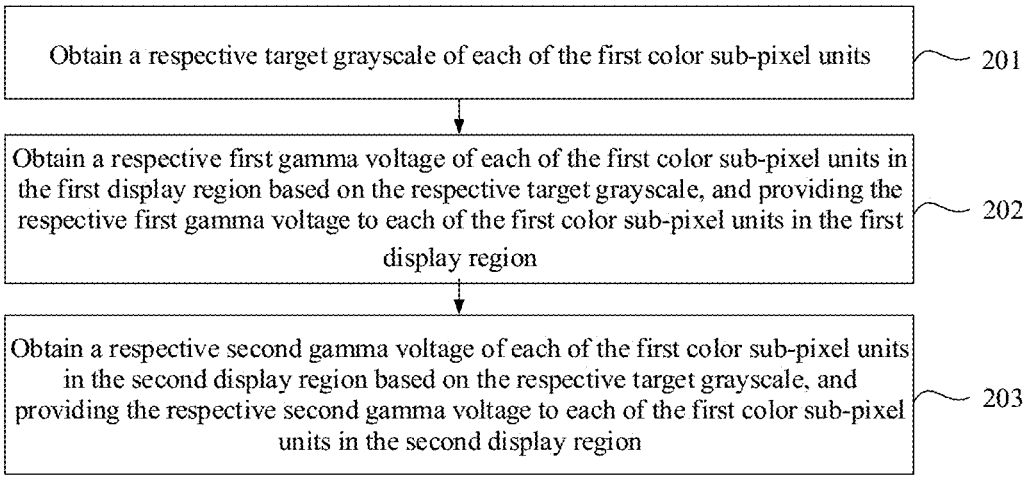
FIG. 2 is a flowchart of steps of a driving method according to an embodiment of the present disclosure.

The embodiments of the present disclosure provide a method for driving a display panel, which can independently perform a gamma or 3gamma correction on different areas of the screen, and improve display uniformity of the display panel. The display panel includes a first display region and a second display region. Each of the first display region and the second display region includes a plurality of first color sub-pixel units. Referring to FIG. 2, the driving method according to an embodiment may include the following steps.

In step 201, the respective target grayscale of each of the first color sub-pixel units is obtained.

The execution subject of this embodiment may be a driver IC. In practice, the execution subject may obtain data, such as a target grayscale of each first color sub-pixel unit, from the main board AP.

In step 202, in the first scanning phase, a respective first gamma voltage of each of the first color sub-pixel units located in the first display region is obtained based on the respective target grayscale, and provided to each of the first color sub-pixels located in the first display region (e.g., outputs the respective first gamma voltage to a respective data line connected to each of the first color sub-pixel units located in the first display region). For example, the respective first gamma voltage corresponding to the respective target grayscale may be obtained by performing a gamma transformation on the respective target grayscale based on a preset first correspondence relationship between a grayscale and a gamma voltage.

In practice, the first correspondence relationship between a grayscale and a gamma voltage can be obtained according to a gamma curve (grayscale-transmittance curve) of the first display region and a voltage-transmittance curve of the first display region. Performing a gamma transformation on a target grayscale in this step refers to determining a first gamma voltage corresponding to the target grayscale based on a first correspondence relationship between the grayscale and the gamma voltage.

In step 203, during the second scanning phase, a respective second gamma voltage of each of the first color sub-pixel units located in the second display region is obtained based on the respective target grayscale and the respective second gamma voltage is provided to each of the first color sub-pixel units located in the second display region (for example, output the respective second gamma voltage to a respective data line connected to each of the first color sub-pixel units located in the second display region). For example, the second gamma voltage corresponding to the target grayscale may be obtained by performing a gamma transformation on the respective target grayscale based on a preset second correspondence relationship between a grayscale and a gamma voltage.

In practice, the second correspondence relationship between a grayscale and a gamma voltage can be obtained according to a gamma curve (grayscale-transmittance curve) of the second display region and a voltage-transmittance curve of the second display region. Performing a gamma transformation on the respective target grayscale in this step refers to determining a respective second gamma voltage corresponding to the respective target grayscale according to a second correspondence relationship between a grayscale and a gamma voltage.

In some embodiments, the first scanning phase and the second scanning phase may occur in parallel. In other embodiments, the first scan phase and the second scan phase occur sequentially.

The first color in this embodiment may be any of red (R), green (G), or blue (B).

In practice, the gamma transformations in steps 202 and 203 may be performed by two gamma voltage generating circuits in the driving IC, respectively. The structure of the gamma voltage generating circuit will be described in detail in the subsequent embodiments.

Figure 3:
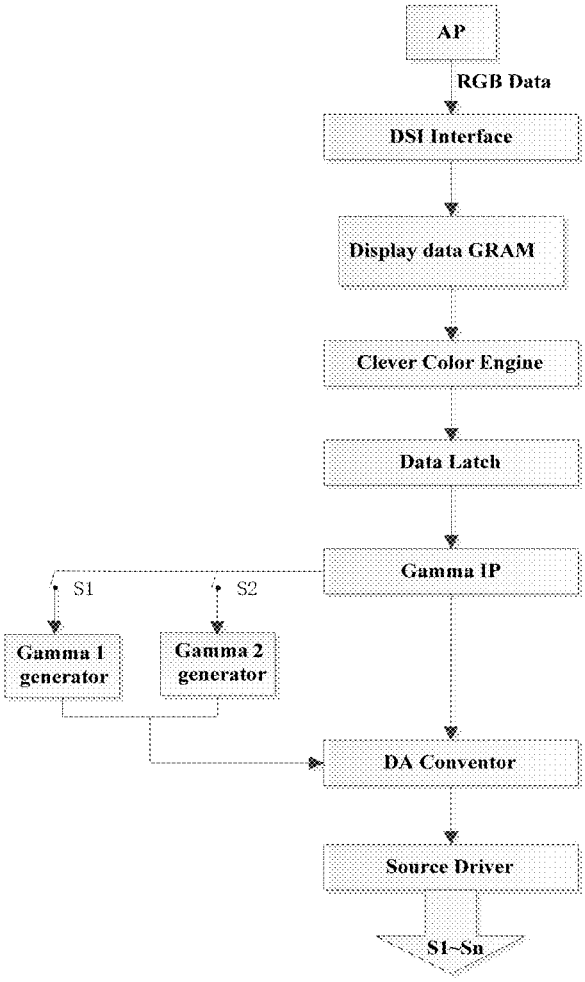
FIG. 3 is a schematic flowchart of a driving method according to an embodiment of the present disclosure.

Referring to FIG. 3, a schematic flowchart of a driving method according to an embodiment is shown. A determining circuit may be added after the driven data latch. The determining circuit is configured to determine a display region to which each of the first color sub-pixel units belongs. If a first color sub-pixel unit is located in the first display region, the first gamma voltage generating circuit (gamma 1 generator) is used to perform a gamma transformation on the respective target grayscale. If a first color sub-pixel unit is located in the second display region, the second gamma voltage generating circuit (gamma 2 generator) is used to perform a gamma transformation on the respective target grayscale. Two gamma voltage generating circuits (gamma 1 generator and gamma 2 generator) are used after the determining circuit, so that an IC can independently perform two 3gamma correction functions to give different 3gamma settings on the upper and lower-half screens (the first display region and the second display region), realizing adjustment of the chromaticity coordinates of different positions on the one display screen.

The driving method according to some embodiments is applied to a display panel. The display panel includes a first display region and a second display region. Each of the first display region and the second display region includes a plurality of first color sub-pixel units (R/G/B). A respective first gamma voltage of each of the first color sub-pixels located in the first display region is determined according to a preset first correspondence relationship between a grayscale and a gamma voltage. A second gamma voltage of each of the first color sub-pixels located in the second display region is determined according to a preset second correspondence relationship between a grayscale and a gamma voltage. Because the correspondence relationship between the grayscales and the gamma voltages in the first display region and the second display region have been pre-adjusted separately, the gamma voltages of grayscales of the same color after the gamma transformation are different, realizing different data voltages. Therefore, the transmittances of the first display region and the second display region can be adjusted independently, and the uniformity of brightness between the first display region and the second display region can be improved. In addition, by pre-adjusting the correspondence relationship between the grayscales and the gamma voltages under different colors, the composition ratio of RGB under different grayscales can be adjusted, thereby achieving independent adjustment of the chromaticity coordinates of the first display region and the second display region, and improving the chromaticity uniformity between the first display region and the second display region.

Figure 4:
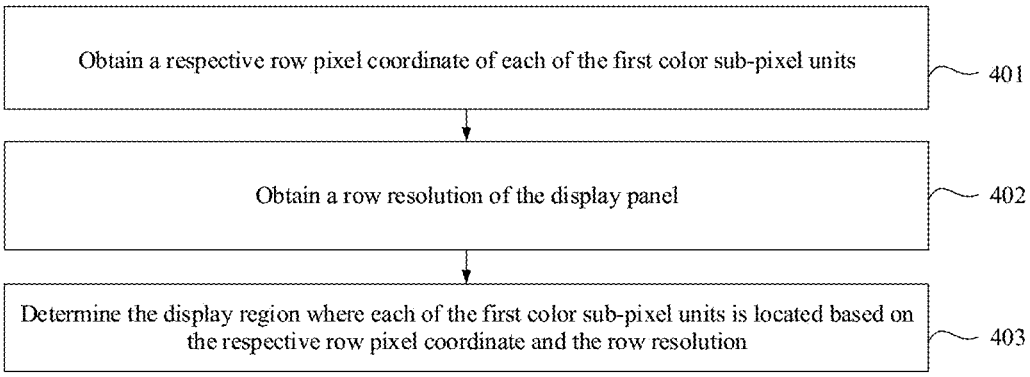
FIG. 4 is a flowchart of a step of determining a display region to which a first color sub-pixel unit belongs according to an embodiment of the present disclosure.

In order to determine the display region to which each of the first color sub-pixel units belongs, before the first scanning phase and the second scanning phase, referring to FIG. 4, a driving method according to an embodiment may further include the followings steps.

In step 401, a respective row pixel coordinate of each of the first color sub-pixel units is obtained.

An image is composed of pixels, and the pixel coordinates are the positions of the pixels in the image. For example, an image coordinate system can be adopted, that is, a direct coordinate system in pixels with the upper left corner of the image as the origin is established. In this embodiment, a row pixel coordinate of a first color sub-pixel unit refers to the number of rows in which the first color sub-pixel unit is located in the image.

In step 402, a row resolution of the display panel is obtained.

In practice, the resolution of the IC output can usually be set through a register. For example, an overall resolution of the display panel may be 2160RGB×3840, and a row resolution of the display panel may be 2160.

In step 403, the display region where each of the first color sub-pixel units is located is determined based on the respective row pixel coordinate and the row resolution.

In some implementations, if the respective row pixel coordinate is less than or equal to half of the row resolution, it is determined that the respective one of the first color sub-pixel units is located in the first display region. If the respective row pixel coordinate is greater than half of the row resolution, it is determined that the respective one of the first color sub-pixel units is located in the second display region.

Specifically, in some embodiments, the determining circuit may specifically determine a display region where the first color sub-pixel unit is located according to a setting of a register. The resolution of the IC output and the scan time of a row can usually be set through a register. For example, assume that the overall resolution is 2160RGB×3840, the first display region has 1 to 1080 rows, and the second display region corresponds to a lower-half of the screen (i.e., lines 1081 to 2160). The IC's internal clock may be used to count. For example, the minimum unit of the oscillation period of the crystal oscillator in the IC is 1 clock, and the scan time of each row is set to n clock. The count time of the first display region is 1080×n clocks, and 1080 is converted into IC register hexadecimal as 0x040x38. When a certain register of the IC is set to 0x040x38 and the IC outputs at rows 1 to 1080, the switch S1 that could turn on a gamma 1 generator is closed, and the IC outputs via the gamma 1 generator. When the IC outputs at rows 1081 to 2160, the switch S1 is turned off and S2 is turned on, and the IC outputs via a gamma 2 generator.

Figure 5:
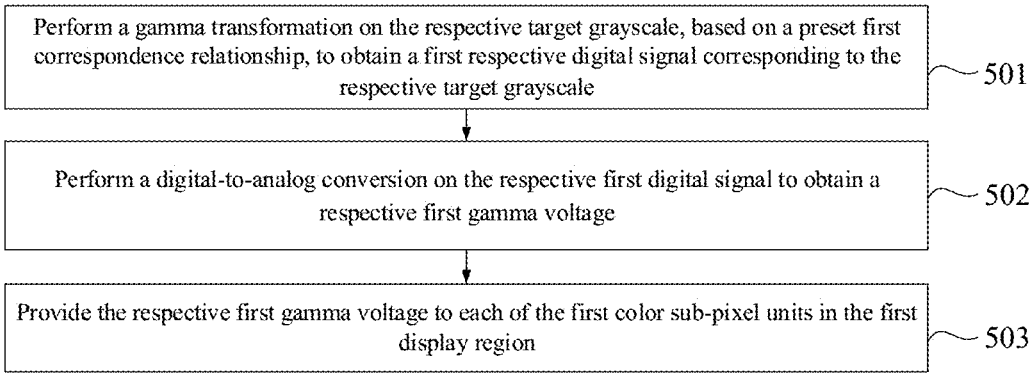
FIG. 5 is a flowchart of performing a gamma transformation in a first scanning phase according to an embodiment of the present disclosure.

In an implementation manner, referring to FIG. 5, step 202 may further include the following steps.

In step 501, a gamma transformation on the respective target grayscale is performed, based on the first correspondence relationship, to obtain a respective first digital signal corresponding to the respective target grayscale.

In step 502, a digital-to-analog conversion is performed on the respective first digital signal to obtain a respective first analog signal (that is, a respective first gamma voltage).

In step 503, the respective first gamma voltage is provided to each of the first color sub-pixel units. For example, the respective first gamma voltage may be output to a respective data line connected to each of the first color sub-pixels to provide the respective first gamma voltage to each of the first color sub-pixel units.

Figure 7:
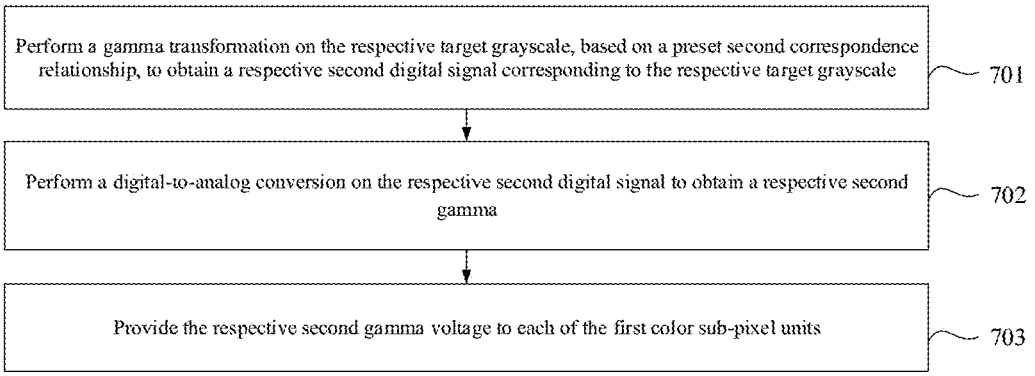
FIG. 7 is a flowchart of steps for performing a gamma transformation in a second scanning phase according to an embodiment of the present disclosure.

In an implementation manner, referring to FIG. 7, step 203 may further include the followings steps.

In step 701, a gamma transformation is performed on the respective target grayscale, based on a preset second correspondence relationship between a grayscale and a gamma voltage, to obtain a respective second digital signal corresponding to the respective target grayscale.

In step 702, a digital-to-analog conversion is performed on the respective second digital signal to obtain a respective second analog signal (that is, a respective second gamma voltage).

In step 703, the respective second gamma voltage is provided to each of the first color sub-pixel units. For example, the respective second gamma voltage may be provided to each of the second color sub-pixel units by outputting the respective second gamma voltage to a respective data line connected to each of the first color sub-pixel units.

Figure 6:
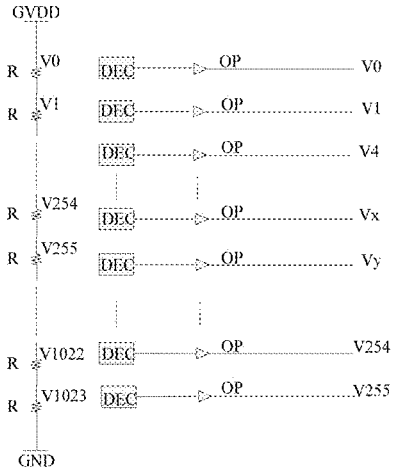
FIG. 6 is a structural view of a gamma voltage generating circuit according to an embodiment of the present disclosure.

Referring to FIG. 6, a schematic structural view of a gamma voltage generating circuit is shown. The gamma voltage generating circuit (gamma 1 generator or gamma 2 generator) implements a conversion of a digital signal (grayscale) to an analog signal (first gamma voltage) through a resistor string. The gamma voltage generating circuit includes a voltage dividing circuit and a decoder DEC. The voltage dividing circuit divides the voltage of Vop (the maximum deflection voltage of the liquid crystal) into $2^{10}$ (that is a total of 1024) parts, according to the preset corresponding relationship between a grayscale and a gamma voltage. Then the DEC of each node of the gamma circuit selects a gamma voltage (a digital signal) of the node according to the grayscale. After the voltage setting is completed, the voltage of the digital signal is converted by a digital-to-analog converter DA converter and an analog operational amplifier OP, to obtain a gamma voltage of an analog signal. The gamma voltage is output to a panel source trace connected to the respective first color sub-pixel unit.

Figure 8:
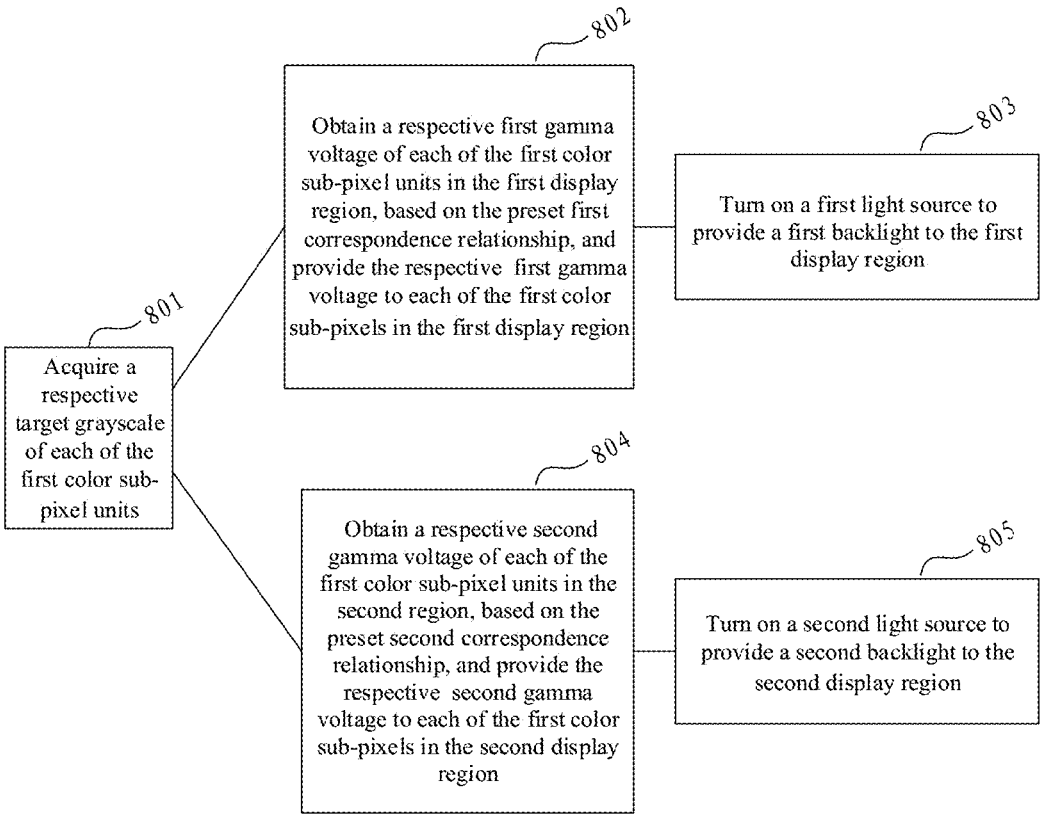
FIG. 8 is a flowchart of steps of another driving method according to an embodiment of the present disclosure.

In order to improve the smear problem of the display panel, the display panel according to an embodiment may adopt a black imagine insertion design. Specifically, referring to FIG. 8, after the first scanning phase (step 802), the method further includes a step 803 of turning on a first light source to provide a first backlight to the first display region.

After the second scanning phase (step 804), The method further includes a step 805 of turning on a second light source to provide a second backlight to the second display region.

Black frame insertion technology is a backlight black frame insertion technology used in liquid crystal display panels to improve liquid crystal smear. Specifically, by turning off the backlight during the panel scan time for one frame scan, waiting for a certain liquid crystal response time, and turning on the backlight technology after the panel liquid crystal finish response.

Figure 9:
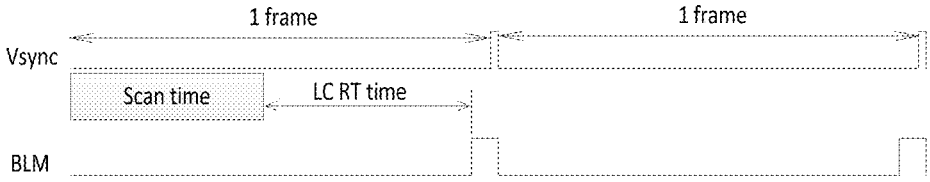
FIG. 9 is a schematic view of a black frame insertion design of a liquid crystal display product according to an embodiment of the present disclosure.

Referring to FIG. 9, a black frame insertion design for a liquid crystal display product is shown. The panel refresh time of the entire frame is compressed to a certain time, that is, the Scan Time shown in the figure. An LCD response time LC RT time is vacated. The backlight BLM is turned on after the LCD response of the entire panel is completed. Therefore, the solution shown in FIG. 9 avoids seeing the process of inverting the liquid crystal when the backlight is bright, and the smear of the display product is improved.

Figure 10:
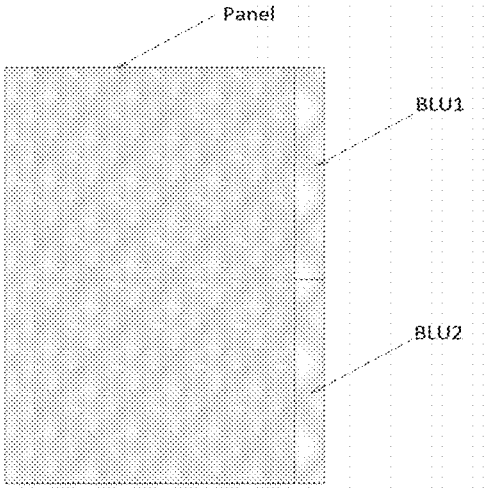
FIG. 10 is a schematic view of a dual-backlight design of a liquid crystal display product according to an embodiment of the present disclosure.

In order to improve the problem of reduced brightness and large loss of light efficiency caused by black frame insertion technology, dual backlight technology can be adopted. Two backlights corresponding to the same panel are turned-on in a time-divisional fashion to realize a solution to avoid the response process of the liquid crystal. Referring to FIG. 10, a schematic view of a dual backlights design of a liquid crystal display product is shown. As shown in FIG. 10, the backlight assembly may include a first backlight unit BLU1 capable of providing a first backlight and a second backlight unit BLU2 capable of providing a second backlight. The first backlight unit may include a first light source and a first light guide member. The second backlight unit may include a second light source and a second light guide member. The first light guide member and the second light guide member may include any of a light guide plate, a lens, and the like.

Figure 11:
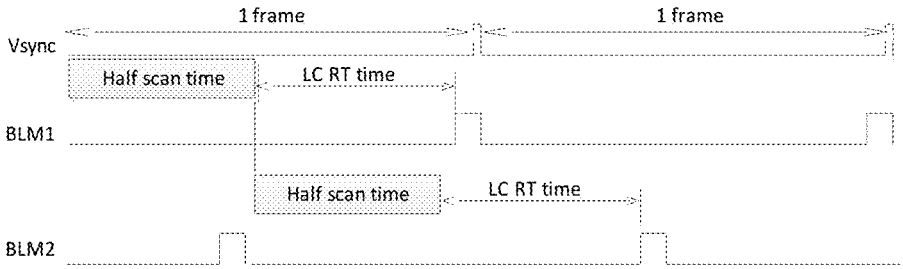
FIG. 11 is a schematic view of a black frame insertion design of a dual-backlight liquid crystal display product according to an embodiment of the present disclosure.

Referring to FIG. 11, a schematic view of a dual-backlight liquid crystal display product with a black frame insertion design is shown. In a display cycle, a scan of the entire panel is divided into an upper-half screen scan and a lower-half screen scan. An upper-half screen scan (half scan time) is performed, then an upper-half screen liquid crystal responds (LC RT time), and the corresponding first backlight unit BLU1 is turned on later. During this period, the scanning of the lower-half screen is not affected. A lower-half screen scan (half scan time) is performed, then a lower-half screen liquid crystal responds (LC RT time), and the corresponding second backlight unit BLU2 is turned on later.

Figure 12:
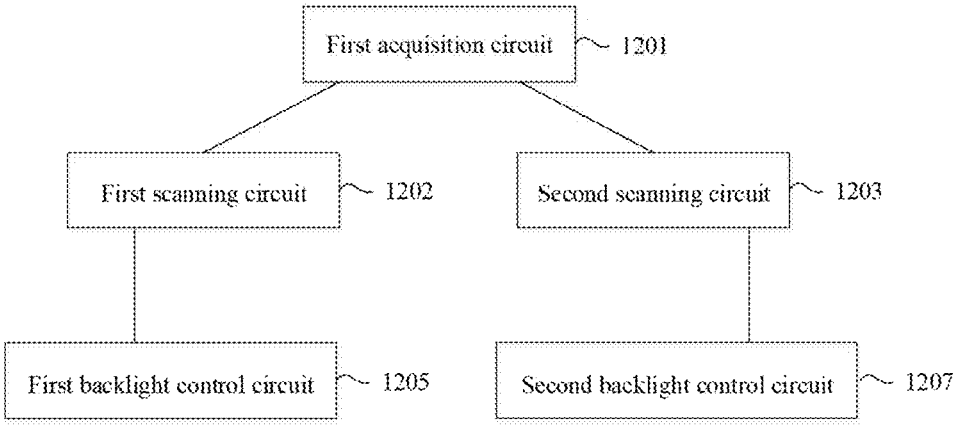
FIG. 12 is a structural block view of a driving device according to an embodiment of the present disclosure.
Figure 13:
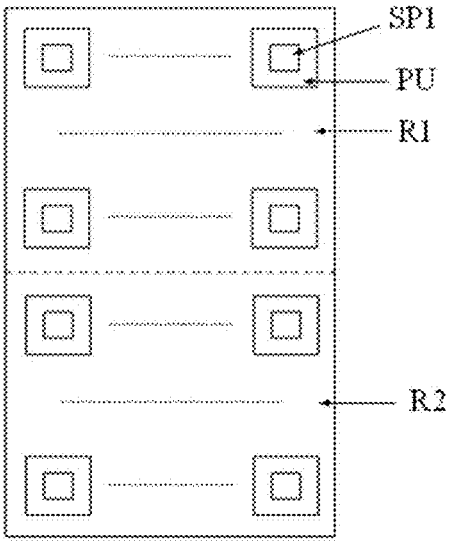
FIG. 13 is a schematic view of a display panel according to an embodiment of the present disclosure.

Some embodiments of the present disclosure provide a driving device for driving a display panel. FIG. 13 illustrates a schematic view of a display panel according to an embodiment of the present disclosure. As shown in FIG. 13, the display panel includes a first display region R1 and a second display region R2. Each of the first display region R1 and the second display region R2 includes a plurality of pixel units PU. A pixel unit includes a first color sub-pixel unit SP1. Referring to FIG. 12, the driving device may include a first acquisition circuit 1201 configured to acquire a respective target grayscale of each of the first color sub-pixel units and a first scanning circuit 1202. The first scanning circuit 1202 is configured to obtain a respective first gamma voltage of each of the first color sub-pixel units located in the first display region, based on the respective target grayscale, and provide the respective first gamma voltage to each of the first color sub-pixel units. For example, the respective first gamma voltage may be provided to a respective data line connected to each of the first color sub-pixel units. In some embodiments, the first scanning circuit is configured to perform a gamma transformation on the respective target grayscale to obtain the respective first gamma voltage based on a preset first correspondence relationship between a grayscale and a gamma voltage.

The second scanning circuit 1203 is configured to, in the second scanning phase, perform a gamma transformation based on the respective target grayscale, to obtain a respective second gamma voltage of each of the first color sub-pixel units located in the second display region, and provide the respective second gamma voltage to each of the first color sub-pixel units. For example, the respective second gamma voltage may be provided to a respective data line connected to each of the first color sub-pixel units. In some embodiments, the second scanning circuit is configured to perform a gamma transformation on the respective target grayscale to obtain a second respective gamma voltage based on a preset second correspondence relationship between a grayscale and a gamma voltage.

In some embodiments, the driving device may further include a second acquisition circuit configured to acquire a respective row pixel coordinate of each of the first color sub-pixel units before the first scanning circuit 1202 and the second scanning circuit 1203 operate, a third acquisition circuit configured to acquire a respective row resolution of the display panel, and a determining circuit configured to determine a display region where each of the first color sub-pixel units is located based on the respective row pixel coordinate and the row resolution.

The determining circuit may be specifically configured to determine, if the respective row pixel coordinate is less than or equal to half of the row resolution, that a respective one of the first color sub-pixel units is located in the first display region, and determine, if the respective row pixel coordinate is greater than half of the row resolution, that a respective one of the first color sub-pixel units is located in the second display region.

In some embodiments, the first scanning circuit 1202 may be specifically configured to perform a gamma transformation on the respective target grayscale, based on the preset first correspondence relationship between a grayscale and a gamma voltage, to obtain a respective first digital signal corresponding to the respective target grayscale, perform a digital-to-analog conversion on the respective first digital signal to obtain a respective first analog signal (i.e., a first gamma voltage), and provide the respective first analog signal to a respective data line connected to each of the first color sub-pixel units. For example, the respective first analog signal may be provided to a respective data line connected to each of the first color sub-pixel units to provide the respective first gamma voltage to each of the first color sub-pixel units.

In some embodiments, the second scanning circuit 1203 may be specifically configured to perform a gamma transformation on the respective target grayscale, based on the preset second correspondence relationship between a grayscale and a gamma voltage, to obtain a respective second digital signal corresponding to the respective target grayscale, perform a digital-to-analog conversion on the respective second digital signal to obtain the respective second gamma voltage, and output the second respective analog signal to a respective data line connected to each of the first color sub-pixel units. For example, the respective second analog signal may be output to a respective data line connected to each of the first color sub-pixel units to provide a respective second gamma voltage to each of the first color sub-pixel units.

As shown in FIG. 12, the device for driving a display panel according to an embodiment may further include a first backlight control circuit 1205 and a second backlight control circuit 1207.

The first backlight control circuit 1205 is configured to, after the respective first gamma voltage is provided by the first scanning circuit 1202, turn on the first light source during the first backlight phase to provide a backlight to the first display region.

The second backlight control circuit 1207 is configured to, after the respective second gamma voltage is provided by the second scanning circuit 1203, turn on the second light source during the second backlight phase to provide a backlight to the second display region.

Regarding the devices in the above embodiments, the specific manners and beneficial effects of the operations performed by the various circuits have been described in detail in the embodiments of the driving method, and will not be described in detail here.

Figure 14:
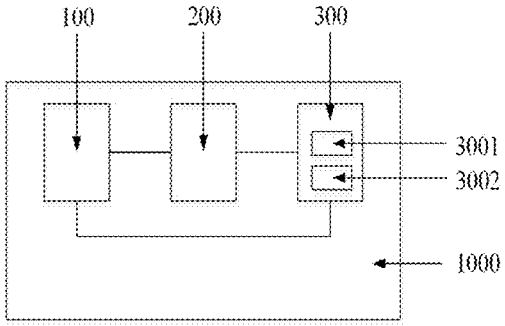
FIG. 14 is a schematic view of a display device according to an embodiment of the present disclosure.

Some embodiments of the present disclosure further provide a display device which may include the driving device for driving a display panel according to any one of the above embodiments. FIG. 14 is a schematic view of a display device according to an embodiment of the present disclosure. As shown in FIG. 14, the display device 1000 may include a driving device 100 for driving a display panel. The device 100 for driving a display panel may be the device for driving a display panel shown in FIG. 12.

It should be noted that the display device in some embodiments may be any product or component having a display function, such as a virtual reality device (VR), electronic paper, mobile phone, tablet computer, television, notebook computer, digital photo frame, and navigator.

In an actual application, as shown in FIG. 14, the display device according to an embodiment may further include a display panel 200 and a backlight assembly 300. The display panel 200 may be a display panel as shown in FIG. 13. The backlight assembly 300 may include a first light source 3001 and a second light source 3002.

The display panel is connected to a driving device for driving the display panel. The display panel includes a first display region and a second display region. Each of the first display region and the second display region includes a plurality of first color sub-pixel units.

The backlight assembly is connected to the display panel and a driving device for driving the display panel. The backlight assembly includes a first light source and a second light source. The first light source is used to provide a backlight to the first display region, and the second light source is used to provide a backlight to the second display region.

Some embodiments provide a method for driving a display panel, a driving device for driving a display panel, and a display device. The display panel includes a first display region and a second display region. Each of the first display region and the second display region includes a plurality of first color sub-pixel units (R/G/B). For each of the first color sub-pixel units located in the first display region, a respective first gamma voltage of the respective first color sub-pixel unit is determined based on a preset first correspondence relationship between a grayscale and a gamma voltage. For each of the first color sub-pixel units located in the second display region, a respective second gamma voltage of the respective first color sub-pixel unit is determined based on a preset second correspondence relationship between a grayscale and a gamma voltage. Since the corresponding relationship between the RGB grayscales and the gamma voltages of the first display region and the second display region has been adjusted separately, the gamma voltages of grayscales of the same color are different after the gamma transformations, and finally the data voltages are different. Therefore, the transmittance of the first display region and the second display region can be adjusted independently, and the uniformity of brightness and chromaticity between the first display region and the second display region can be improved.

Each embodiment in this specification is described in a progressive manner. Each embodiment focuses on the differences from other embodiments, and the same or similar parts between the various embodiments may refer to each other.

Finally, it should be noted that in this disclosure, relational terms such as first and second are used only to distinguish one entity or operation from another entity or operation, and do not necessarily require or imply there is any such actual relationship or order between these entities or operations. Moreover, the terms "include," "comprise," "have" or any other variation thereof are intended to encompass non-exclusive inclusion, such that a process, method, product, or device that includes a series of elements includes not only those elements but also those that are not explicitly listed, or elements that are inherent to such process, method, product, or device. Without more restrictions, the elements defined by the sentence "including a . . . " do not exclude the existence of other identical elements in the process, method, product or device including the elements.

The driving method, driving device, and display device provided by the present disclosure have been described in detail above. Specific examples have been used to explain the principles and implementation of the present disclosure. The descriptions of the above embodiments are only used to help understanding this disclosure and its core ideas. Meanwhile, for those of ordinary skill in the art, according to the ideas of this disclosure, there will be changes in the specific implementation and application scope which also fall within the scope and spirit of the disclosure. The specification content should not be construed as limiting the present disclosure.

The invention claimed is:

1. A method for driving a display panel comprising a first display region and a second display region, each of the first display region and the second display region comprising a plurality of first sub-pixel units, the method comprising:

obtaining a respective target grayscale of each of the first color sub-pixel units; obtaining a respective first gamma voltage of each of the first color sub-pixel units located in the first display region based on a respective target grayscale, and providing the respective first gamma voltage to each of the first color sub-pixel units; and obtaining a respective second gamma voltage of each of the first color sub-pixel units located in the second display region based on the respective target grayscale, and providing the respective second gamma voltage to each of the first color sub-pixel units, wherein obtaining the respective first gamma voltage of each of the first color sub-pixel units located in the first display region based on the respective target grayscale comprises obtaining the first gamma voltage corresponding to the target grayscale based on a preset first correspondence relationship between a grayscale and a gamma voltage, and wherein obtaining the respective second gamma voltage of each of the first color sub-pixel units located in the second display region based on the respective target grayscale comprises obtaining the second gamma voltage corresponding to the target grayscale based on a preset second correspondence relationship between a grayscale and a gamma voltage.

2. The method according to claim 1, further comprising, before obtaining the respective first gamma voltage of each of the first color sub-pixel units located in the first display region and obtaining the second gamma voltage of each of the first color sub-pixel units located in the second display region:

obtaining a respective row pixel coordinate of each of the first color sub-pixel units; obtaining a row resolution of the display panel; and determining the display region that each of the first color sub-pixel units is located in, based on the respective row pixel coordinate and the row resolution.

3. The method according to claim 2, wherein determining the display region that each of the first color sub-pixel units is located in based on the respective row pixel coordinate and the row resolution comprises:

determining that the respective one of the first color sub-pixel units is located in the first display region if the respective row pixel coordinate is less than or equal to half of the row resolution; and determining that the respective one of the first color sub-pixel units is located in the second display region if the respective row pixel coordinate is greater than half of the row resolution.

4. The method according to claim 1, wherein obtaining the respective first gamma voltage of each of the first color sub-pixel units based on a preset first correspondence relationship between a grayscale and a gamma voltage comprises:

performing a gamma transformation on the respective target grayscale based on the first correspondence relationship to obtain a respective first digital signal corresponding to the respective target grayscale; and performing a digital-to-analog conversion on the respective first digital signal to obtain the respective first gamma voltage.

5. The method according to claim 1, wherein obtaining the respective second gamma voltage based on a preset second correspondence relationship between the grayscale and the gamma voltage comprises:

performing a gamma transformation on the respective target grayscale based on the second correspondence relationship to obtain a respective second digital signal corresponding to the respective target grayscale; and performing a digital-to-analog conversion on the respective second digital signal to obtain the respective second gamma voltage.

6. The method of claim 1, further comprising:

providing a first backlight to the first display region after the respective first gamma voltage is provided to each of the first color sub-pixel units located in the first display region; and providing a second backlight to the second display region after the respective second gamma voltage is provided to each of the first color sub-pixel units located in the second display region.

7. A driving device for driving a display panel, the display panel comprising a first display region and a second display region, each of the first display region and the second display region comprising a plurality of first color sub-pixel units, the driving device comprising:

a first acquisition circuit configured to acquire a respective target grayscale of each of the first color sub-pixel units;

a first scanning circuit configured to obtain a respective first gamma voltage of each of the first color sub-pixel units located in the first display region based on the respective target grayscale, and provide the respective first gamma voltage to each of the first color sub-pixel unit located in the first display region; and a second scanning circuit configured to obtain a respective second gamma voltage of each of the first color sub-pixel units located in the second display region based on the respective target grayscale, and provide the respective second gamma voltage to each of the first color sub-pixel units located in the second display region, wherein the first scanning circuit is configured to perform a gamma transformation on the respective target grayscale to obtain the respective first gamma voltage, based on a preset first correspondence relationship between a grayscale and a gamma voltage, and wherein the second scanning circuit is configured to perform a gamma transformation on the respective target grayscale to obtain the respective second gamma voltage, based on a preset second correspondence relationship between a grayscale and a gamma voltage.

8. The driving device according to claim 7, further comprising:

a second acquisition circuit configured to acquire a respective row pixel coordinate of each of the first color sub-pixel units;

a third acquisition circuit configured to acquire a row resolution of the display panel; and a determining circuit configured to determine the display region that each of the first color sub-pixel units is located in based on the respective row pixel coordinate and the row resolution.

9. The driving device according to claim 8, wherein the determining circuit is configured to:

determine that a respective one of the first color sub-pixel units is located in the first display region if the respective row pixel coordinate is less than or equal to half of the row resolution; and determine that a respective one of the first color sub-pixel units is located in the second display region if the respective row pixel coordinate is greater than half of the row resolution.

10. The driving device according to claim 7, wherein the first scanning circuit is configured to obtain the respective first gamma voltage based on a preset first correspondence relationship between a grayscale and a gamma voltage by:

performing a gamma transformation on the respective target grayscale to obtain a respective first digital signal corresponding to the respective target grayscale, based on the first correspondence relationship; and performing a digital-to-analog conversion on the respective first digital signal to obtain the respective first gamma voltage.

11. The driving device according to claim 7, wherein the second scanning circuit is configured to obtain the respective second gamma voltage based on a preset second correspondence relationship between a grayscale and a gamma voltage by:

performing a gamma transformation on the respective target grayscale to obtain a respective second digital signal corresponding to the respective target grayscale, based on the second correspondence relationship; and performing a digital-to-analog conversion on the respective second digital signal to obtain the respective second gamma voltage.

12. The driving device according to claim 6, further comprising:

a first backlight control circuit configured to turn on a first light source for the first color sub-pixel units located in the first display region to provide a backlight to the first display region after the first scanning circuit provides the respective first gamma voltage to each of the first color sub-pixel units located in the first display region; and a second backlight control circuit configured to turn on a second light source for the first color sub-pixel units located in the second display region to provide a backlight to the second display region after the second scanning circuit provides the respective second gamma voltage to each of the first color sub-pixel units located in the second display region.

13. A display device comprising the driving device for driving a display panel according to claim 7.

14. The display device according to claim 13, further comprising:

a display panel connected to the driving device, the display panel comprising a first display region and a second display region, each of the first display region and the second display region comprising a plurality of first color sub-pixel units; and a backlight assembly connected to the display panel and the driving device, respectively, wherein the backlight assembly comprises a first light source for providing a backlight to the first display region and a second light source for providing a backlight to the second display region.

15. The display device according to claim 13, wherein the first scanning circuit is configured to perform a gamma transformation on the respective target grayscale to obtain the respective first gamma voltage, based on a preset first correspondence relationship between a grayscale and a gamma voltage, and wherein the second scanning circuit is configured to perform a gamma transformation on the respective target grayscale to obtain the respective second gamma voltage, based on a preset second correspondence relationship between a grayscale and a gamma voltage.

16. The display device according to claim 15, wherein the driving device further comprises:

a second acquisition circuit configured to acquire a respective row pixel coordinate of each of the first color sub-pixel units;

a third acquisition circuit configured to acquire a row resolution of the display panel; and a determining circuit configured to determine the display region that each of the first color sub-pixel units is located in based on the respective row pixel coordinate and the row resolution.

17. The display device according to claim 16, wherein the determining circuit is configured to:

determine that a respective one of the first color sub-pixel units is located in the first display region if the respective row pixel coordinate is less than or equal to half of the row resolution; and determine that a respective one of the first color sub-pixel units is located in the second display region if the respective row pixel coordinate is greater than half of the row resolution.

18. The display device according to claim 15, wherein the first scanning circuit is configured to obtain the respective first gamma voltage based on a preset first correspondence relationship between a grayscale and a gamma voltage by:

performing a gamma transformation on the respective target grayscale to obtain a respective first digital signal corresponding to the respective target grayscale, based on the first correspondence relationship; and performing a digital-to-analog conversion on the respective first digital signal to obtain the respective first gamma voltage, and wherein the second scanning circuit is configured to obtain the respective second gamma voltage based on a preset second correspondence relationship between a grayscale and a gamma voltage by:

performing a gamma transformation on the respective target grayscale to obtain a respective second digital signal corresponding to the respective target grayscale, based on the second correspondence relationship;

performing a digital-to-analog conversion on the respective second digital signal to obtain the respective second gamma voltage.

* * * * *